United States Patent [19]

Shaw

[11] Patent Number: 4,739,804

[45] Date of Patent: Apr. 26, 1988

[54] SHED-FORMING ARRANGEMENT FOR RECTILINEAR WEAVING LOOMS WITH WAVY SHED

[75] Inventor: Henri Shaw, Woesten-Vleteren, Belgium

[73] Assignee: Picanol N.V., Belgium

[21] Appl. No.: 873,532

[22] Filed: Jun. 12, 1986

[30] Foreign Application Priority Data

Jun. 14, 1985 [BE] Belgium ..... 2/60715

[51] Int. Cl.[4] ..... D03D 47/26

[52] U.S. Cl. ..... 139/436; 139/13 R

[58] Field of Search ..... 139/13 R, 436, 82, 84

[56] References Cited

U.S. PATENT DOCUMENTS 2,255,608 9/1941 Baumgarten ..... 139/13 R
3,664,380 5/1972 Haberhauer et al. ..... 139/13 R
4,432,397 2/1984 Cacciapuoti ..... 139/13 R

FOREIGN PATENT DOCUMENTS 559883 9/1934 Fed. Rep. of Germany ..... 139/82
699084 11/1940 Fed. Rep. of Germany .... 139/13 R
821479 11/1951 Fed. Rep. of Germany ..... 139/13
2349653 4/1975 Fed. Rep. of Germany .... 139/13 R
1346144 2/1974 United Kingdom ..... 139/436

*Primary Examiner*—Henry S. Jaudon
*Attorney, Agent, or Firm*—Bacon & Thomas

[57] ABSTRACT

A wavy shed forming arrangement for rectilinear weaving looms it consists of a wobbling non-rotating element driven about a driving axis and connected by connections to be reciprocated which are fixed to the lifters on which the warp threads are suspended.

11 Claims, 3 Drawing Sheets

SHED-FORMING ARRANGEMENT FOR RECTILINEAR WEAVING LOOMS WITH WAVY SHED

BACKGROUND OF THE INVENTION

1. Field of the Invention

The present invention relates to a wavy shed-forming arrangement for rectilinear weaving looms, more specifically weaving looms wherein the lifters for the warp threads are commanded in such a way that the pattern formed by a section along the length of the shed exhibits a running wave motion.

2. Description of Related Art

Various shed-forming arrangement are known for generating a wavy shed in a rectilinear weaving loom, wherein a desired motion is imposed either separately on all lifters on which the warp threads are suspended, or in groups by means of narrow cams, each of which can control up to thirty lifters.

The known embodiments of shed-forming arrangements use cam gears, eccentric mechanisms, gear mechanisms, pneumatic cog-wheel mechanisms, pattern-forming mechanisms similar to dobbies or jacquard mechanisms and shed-forming mechanisms, of the drum type.

BRIEF SUMMARY OF THE INVENTION

The present invention relates to a shed-forming arrangement which is totally different from those known arrangements and which consists of a wobbling element; means for driving the latter to produce wobbling motion; and, connected to said wobbling element, connections that are reciprocated by the driven wobbling element and which in turn are connected to lifters on which the warp threads are suspended.

In the preferred embodiment the wobbling element is embodied in the form of a circular disk.

DESCRIPTION OF THE DRAWINGS

In order to better emphasize the features of the present invention and without limiting the scope of the invention, a number of preferred embodiments are exemplified in the accompanying drawings, wherein.

DESCRIPTION OF PREFERRED EMBODIMENTS

Figure 1:
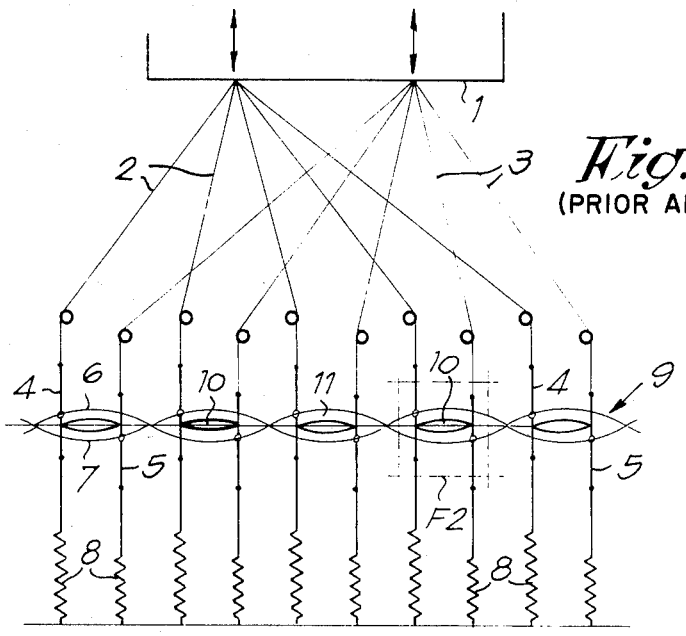
Fig. 1 (PRIOR ART)
FIG. 1 represents schematically and generally the shed formation in weaving looms with a wavy shed.
Figure 2:
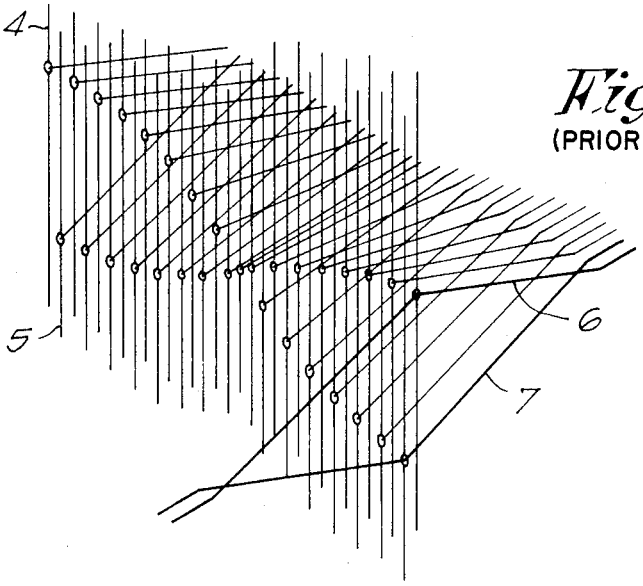
Fig. 2 (PRIOR ART)
FIG. 2 represents a perspective view of a section of the part which in FIG. 1 is indicated by arrow F2.

In order to better elucidate the object of the present invention, the general principle of shed formation in wavy shed weaving looms according to the prior art is schematically represented in FIGS. 1 and 2.

A shed-forming arrangement 1 imposes via connections such as the threads 2 and 3 a predetermined motion to the lifters 4 and 5 wherein the warp threads 6 and 7 respectively are caught and guided. For that purpose, an upward motion is imposed by the shed-forming arrangement 1 to the threads 2 and 3, whereas the downward motion of the lifters 4 and 5 is obtained as is known by means of resilient elements such as, e.g., tension springs 8. In a wavy-shed weaving loom the motion of the lifters 4-5 takes place in such a way that the shed exhibits a regular wave form repeating itself over the complete weaving width.

According to the principle known per se in weaving looms with wavy sheds the wave pattern 9 generated by the shed forming arrangement thereby allows several shoot supports 10 to be moved by the formed and travelling shed openings 11.

Figure 3:
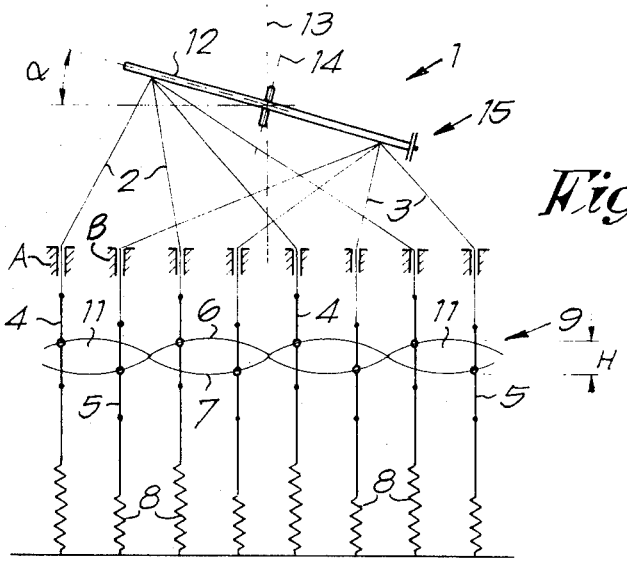
FIG. 3 represents schematically the shed-forming arrangement according to the present invention.
Figure 4:
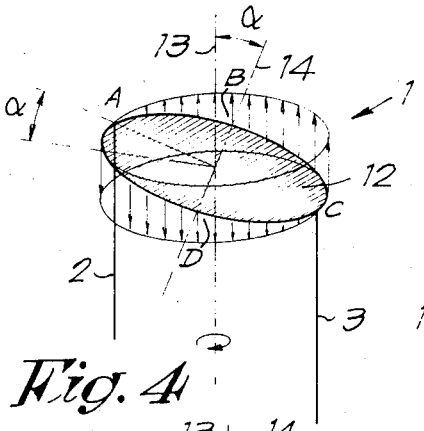
FIG. 4 represents schematically the motion of the wobbling disk.

In FIG. 3, a shed-forming arrangement 1 according to this invention is schematically represented wherein use is made of a wobbling element which is preferably formed by a circular disk 12. The wobbling motion of disk 12 is represented in FIG. 4. The means for driving disk 12 in a wobbling motion comprises mounting the disk 12 on an axis 14 that in turn is mounted on an incline relative to a drive shaft having a drive access 13, and rotating the axis 14 with the disk 12 about axis 13 while disk 12 is restrained from rotation. Preferably, the axis 14 extends with the normal to the plane of disk 12.

Consequently, the wobbling element or the disk 12 makes exclusively a wobbling motion without rotating.

Figure 7:
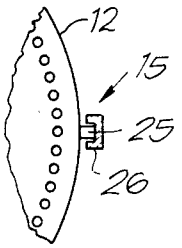
FIG. 7 represents a section according to line VII—VII in FIG. 6.

The threads (i.e. flexible strands or connecting means) 2, 3 are attached at various radii in a circular pattern along the peripheral area of disk 12 (FIG. 7, for example shows a circular pattern of connecting points of threads 2, 3 on disk 12). Thus, as disk 12 is driven in a wobbling motion about a vertical drive axis, points located around the peripheral edge of the disk will effectively reciprocate up and down with at least a component of motion parallel to the drive axis. Points closer to the drive axis will move up and down less than points located at the very edge of the disk.

It is clear that in any instantaneous position such as the one represented in FIG. 4, the points lying along the arc A-B-C formed by a part of the periphery of disk 12 effect an upward motion, whereas at the other hand all points lying on the arc C-D-A move downwards. By attaching the necessary threads 2 and 3 to the required radius of disk 12, whereby these threads 2 and 3 as aforesaid are linked to the lifters 4-5, a wavy shed is obtained with the desired shed height H as schematically represented in FIG. 3 when the disk is driven to effect wobbling motion.

It should be noted that for clarity's sake only some warp lifters 4-5 and junctions of threads 2-3 are represented in the figures. In reality, their number is much larger, of course.

In FIG. 3, threads 2, 3 extend through apertures B in a fixed member A on the loom so that vertical motion of the threads 2, 3 is transmitted to the lifters 4, 5 and vice versa due to the springs 8.

Figure 5:
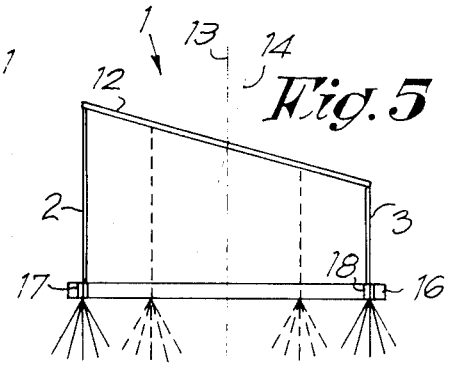
FIG. 5 represents schematically a variant of the upper part of FIG. 3.

In the embodiment of FIG. 5 a shed-forming arrangement 1 is represented which is also equipped with a fixed disk 16 extending substantially radially with respect to the aforesaid shaft 13. All the connections with the lifters, among other things the threads 2 and 3, that are to be attached to one same point of the periphery of the wobbling disk 12, are grouped in said fixed disk 16 by guiding them through openings, e.g. 17 and 18, provided herein. It is clear that an entanglement of the threads 2-3 becomes practically impossible thereby. The threads 2, 3, of course, are connected to lifters in the same manner as shown in FIG. 3, through a fixed member A.

Figure 6:
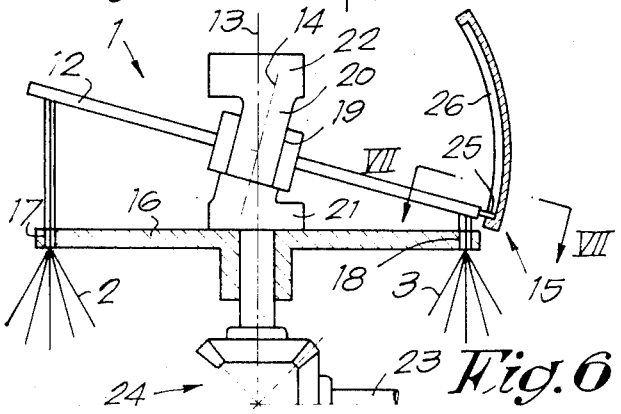
FIG. 6 represents a practical embodiment.

In FIG. 6 a practical embodiment of the shed-forming arrangement 1 according to FIG. 5 is represented.

The wobbling disk 12 is fixed freely rotatable relative to an oblique shaft part 20 carrying access 14 by means of a bearing 19 which part is provided between coaxial shaft parts 21 and 22 respectively.

A possible driving of the wobbling disk 12 consists arrangement for a connection of the shaft part 21 with a driving shaft 23 by means of bevel gears 24.

The locking arrangement 15 for blocking the whirling disk 12 against rotation comprises a pin 25 attached to the disk 12 which cooperates with a vertical guide 26 to prevent disk rotation while permitting wobbling of the disk while it is driven by shaft 13.

Figure 8:
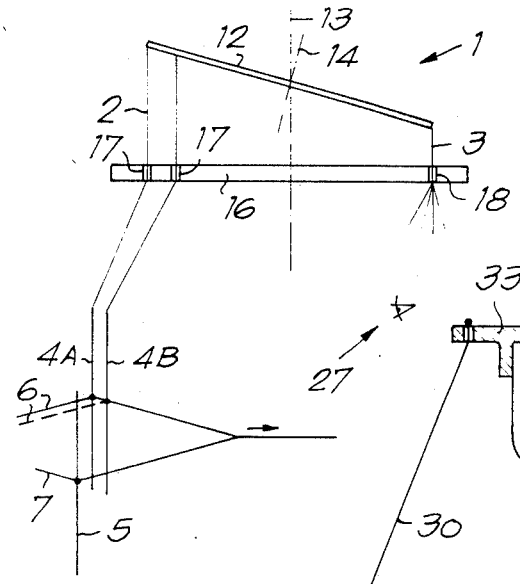
FIG. 8 represents schematically an application with lifters placed one behind the other.

Because of the large number of warp threads 6-7 the lifters are placed one behind the other in a known way in a number of rows. It is then clear indeed that a number of lifters, e.g. the lifters 4A in FIG. 8, have to be moved over a height different from that of the lifters of another row, e.g. the lifters 4B. According to the present invention this is realized by fixing the lifters arranged one behind the other 4A and 4B respectively by means of the aforesaid connections 2 to a different radius of the disk 12.

The hindmost row of lifters 4A with respect to the weaver are attached the most remotely from shaft 13, whereas the row of lifters 4B closest to the weaver more closely towards shaft 13 are attached to the disk 12.

According to a variant of the invention not represented in the figures, the shed-forming arrangement 1 mainly consists of a wobbling element, preferably a disk, said element being adjustable at different angles whereby the height of lifters 4 and thus shed height H can be regulated.

Figure 9:
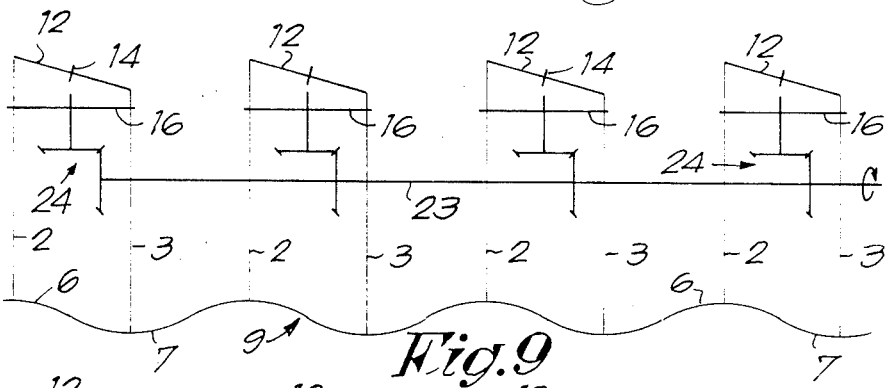
FIGS. 9 and 10 represent schematical embodiments wherein the shed-forming arrangement consists of a plurality of wobbling elements or disks.

In FIG. 9 a shed-forming arrangement 1 according to the present invention is represented schematically which is particularly applicable to weaving looms with a great weaving width but which is not necessary therefor, however. In order to make the abovesaid threads 2 and 3 less intricate, the shed-forming arrangement 1 consists of a string of several wobbling elements working in phase, such as e.g. the aforesaid disks 12.

Figure 10:
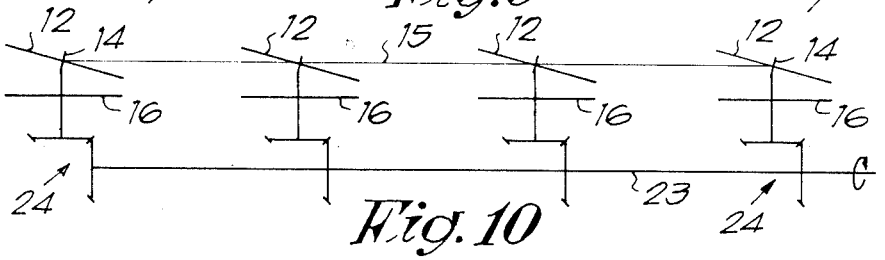

Driving of the wobbling elements can then be carried out jointly, wherein it should be observed, however, that the different wobbling disks 12 match with one another, all of this in such a way that the above wave pattern 9 is obtained; the wobbling elements or disks 12 can be connected together with means 15 locking them against rotation, as shown in FIG. 10.

Naturally, such a wobbling element can be realized according to many embodiments without departing from the scope of the invention.

Figure 11:
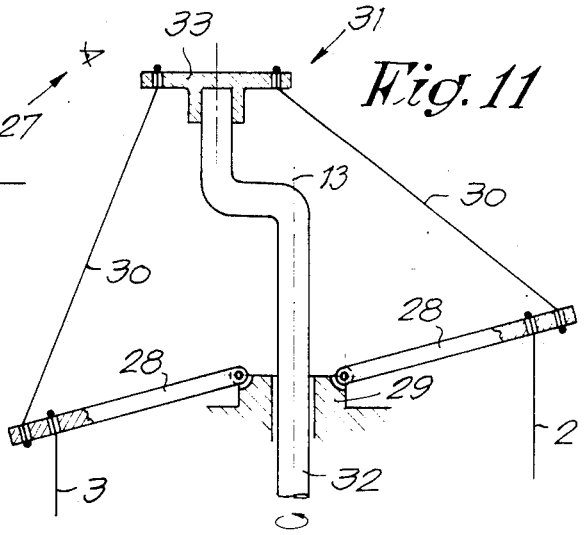
FIG. 11 represents a variant of the wobbling disk of the foregoing figures.

It is not necessary for such a wobbling element to be constituted by the abovesaid disk 12. To make the matter clear, another variant is represented in FIG. 11, wherein the wobbling element consists of a number of radial rods 28 arranged in a circular pattern and hingedly fixed to a base 29 at one end around driving shaft 32 turning about axis 13 The rods 28 are progressively moved up and down at their free ends by means of driving connections 30 that are attached to an orbiting eccentric 31. Herein the latter is driven in a single plane by means of a shaft 32 about axis 13, but the upper part 33 to which said connections 30 are fixed makes herein only a circular orbital motion without, however, rotating around its own axis. It is clear that said rods 28 at their free end are attached by threaded 2, 3 to to the lifters 4 and 5 respectively as described above.

The present invention is by no means limited to the exemplified embodiments represented in the accompanying drawings, but such a shed-forming arrangement for weaving loom with a wavy shed as well as the composing parts thereof can be realized in any form and dimensions without departing from the scope of the invention.

I claim:

1. A wavy shed-forming arrangement for rectilinear weaving looms including rectilinear warp lifters, comprising a wobbling element; means for driving the latter about a driving axis for producing a wobbling motion about the driving axis, such wobbling motion generating vertical reciprocating motion at points disposed on the wobbling element around the driving axis; connecting means connected between said points on the wobbling element and rectilinear warp lifters of the loom; wobbling motion of the wobbling element causing reciprocation of the connecting means and the rectilinear warp lifters; a fixed plate element disposed between the wobbling element and said warp lifters, said plate element including apertures; said connecting elements comprising flexible strand members extending through said apertures and being guided thereby for distribution to said rectilinear warp lifters.

2. A wavy shed-forming arrangement for rectilinear weaving looms including rectilinear warp lifters, comprising a wobbling element; means for driving the latter about a driving axis for producing a wobbling motion about the driving axis, such wobbling motion generating vertical reciprocating motion at points disposed on the wobbling element around the driving axis; connecting means connected between said points on the wobbling element and rectilinear warp lifters of the loom; wobbling motion of the wobbling element causing reciprocation of the connecting means and the rectilinear warp lifters; said wobbling element comprising a circular array of rods axially extending from a central axis, said rods pivotally connected at their ends closest to the central axis to a fixed point and said connecting means attached to the rods at selected radii from the pivot connection of each rod; said driving means for the wobbling element comprising a non-rotating coupling arranged to be driven in a single plane by the driving means in an orbital path around the central axis; said coupling connected to each rod at a radius from its pivot point by driving connection means having a selected length.

3. A wavy shed-forming arrangement for rectilinear weaving looms including rectilinear warp lifters, comprising a wobbling element; means for driving the latter about a driving axis for producing a wobbling motion about the driving axis, such wobbling motion generating vertical reciprocating motion at points disposed on the wobbling element around the driving axis; connecting means connected between said points on the wobbling element and rectilinear warp lifters of the loom; wobbling motion of the wobbling element causing reciprocation of the connecting means and the rectilinear warp lifters; said wobbling element comprising substantially a disk, said driving means comprising a drive shaft having an oblique shaft extention inclined relative to said driving axis, said coupling rotatably securing said wobbling element to said extension, whereby rotation of said drive shaft rotates said oblique shaft extension about the driving axis and causes wobbling motion of said wobbling element through said coupling.

4. A wavy shed-forming arrangement for rectilinear weaving looms including rectilinear warp lifters, comprising a wobbling element; means for driving the latter about a driving axis for producing a wobbling motion about the driving axis, such wobbling motion generating vertical reciprocating motion at points disposed on the wobbling element around the driving axis; connecting means connected between said points on the wobbling element and rectilinear warp lifters of the loom; wobbling motion of the wobbling element causing reciprocation of the connecting means and the rectilinear warp lifters; said wobbling element being connected to its driving means by a coupling means; said driving means being rotatable about said driving axis; said coupling means securing said wobbling means to its driving means at an angle of incidence inclined relative to the driving axis while permitting relative rotation between the driving means and wobbling element; said means for preventing rotation of the wobbling element comprising a pin that is fixed to a peripheral edge area of said wobbling element, said pin engaging a guide that accommodates vertical reciprocating travel of the pin but prevents rotational movement of the wobbling element; whereby rotation of the driving means relative to the wobbling element causes wobbling motion of the wobbling element around the driving axis without rotation of the wobbling element.

5. A wavy shed forming arrangement according to claim 1, 2, 3 or 4, wherein said wobbling element comprises substantially a disk.

6. A wavy shed forming arrangement according to claim 1, 3 or 4, wherein the connecting means are fixed to said wobbling element at different distances from the driving axis, the connecting means for the lifters that have to perform the largest movement being fixed further away from the driving axis than the connecting means for the lifters that have to perform a smaller movement.

7. A wavy shed forming arrangement according to claim 1, 3 or 4, wherein the connecting means for the lifters of the warp threads that occupy the same instantaneous position during operation of the loom are fixed at a same point on the wobbling element.

8. A wavy shed forming arrangement according to claim 1, 3 or 4, including a plurality of wobbling elements arranged to wobble simultaneously during loom operation.

9. A shed forming arrangement according to claim 8, including counterrotation means connected between the wobbling elements to prevent rotation of the wobbling elements.

10. A wavy shed forming arrangement according to claim 4, wherein the angle of incidence is adjustable.

11. A wavy shed forming arrangement according to claim 1, wherein the means for driving said wobbling elements comprises bevel gears connected to a loom drive shaft.

* * * * *